US009445205B2

(12) United States Patent
Huettinger et al.

(10) Patent No.: US 9,445,205 B2
(45) Date of Patent: Sep. 13, 2016

(54) DYNAMIC HEARING AID SYSTEM AND A METHOD FOR CONFIGURING THE HEARING AID SYSTEM

(71) Applicants: SIEMENS LTD., CHINA, Beijing (CN); SIVANTOS PTE. LTD., Singapore (SG)

(72) Inventors: Simon Huettinger, Erlangen (DE); Mattias Lampe, Beijing (CN); Jie Zhang, Beijing (CN)

(73) Assignees: Siemens Ltd., China, Beijing (CN); Sivantos Pte. Ltd., Singapore (SG)

( * ) Notice: Subject to any disclaimer, the term of this patent is extended or adjusted under 35 U.S.C. 154(b) by 0 days.

(21) Appl. No.: 14/432,249

(22) PCT Filed: Sep. 28, 2012

(86) PCT No.: PCT/CN2012/082335

§ 371 (c)(1),
(2) Date: Mar. 30, 2015

(87) PCT Pub. No.: WO2014/047884

PCT Pub. Date: Apr. 3, 2014

(65) Prior Publication Data

US 2015/0312685 A1 Oct. 29, 2015

(51) Int. Cl.

| | |
|---|---|
| ***H04R 25/00*** | (2006.01) |
| ***H04R 5/04*** | (2006.01) |
| *H04R 5/033* | (2006.01) |

(52) U.S. Cl.

CPC ..... *H04R 25/554* (2013.01); *H04R 5/04* (2013.01); *H04R 25/55* (2013.01); *H04R 5/033* (2013.01); *H04R 25/552* (2013.01); *H04R 2225/55* (2013.01)

(58) Field of Classification Search

CPC ..... H04R 25/505; H04R 2225/41; H04R 25/356; H04R 25/558; H04R 25/502; H04R 25/70

USPC ..... 381/312, 313, 322, 326, 327, 328, 330

See application file for complete search history.

(56) References Cited

U.S. PATENT DOCUMENTS

| | | | | |
|---|---|---|---|---|
| 5,696,833 | A | 12/1997 | Matzen et al. | |
| 8,532,318 | B2 * | 9/2013 | Isozaki | H04R 25/552 381/312 |
| 2007/0223725 | A1 | 9/2007 | Neumann et al. | |
| 2008/0240449 | A1 * | 10/2008 | Kornagel | H04R 25/552 381/23.1 |

(Continued)

FOREIGN PATENT DOCUMENTS

| | | | |
|---|---|---|---|
| CN | 101924977 | A | 12/2010 |
| CN | 202135319 | U | 2/2012 |
| EP | 2182742 | A1 | 5/2010 |

(Continued)

*Primary Examiner* — Brian Ensey

(74) *Attorney, Agent, or Firm* — Laurence A. Greenberg; Werner H. Stemer; Ralph E. Locher

(57) ABSTRACT

A dynamic hearing aid system and a method for configuring the hearing aid system. The dynamic hearing aid system includes a first hearing device and a second hearing device, and a controller adapted to communicate with each other. The hearing devices and the controller form a master-slave configuration wherein one of the hearing devices is the master hearing device in the master-slave configuration and the other hearing device is the slave hearing device.

15 Claims, 2 Drawing Sheets

(56) References Cited

U.S. PATENT DOCUMENTS

| | | | |
|---|---|---|---|
| 2010/0158292 | A1 | 6/2010 | Pedersen |
| 2011/0235833 | A1 | 9/2011 | Hensen |

FOREIGN PATENT DOCUMENTS

| | | | |
|---|---|---|---|
| WO | 2004110099 | A2 | 12/2004 |
| WO | 2011031910 | A1 | 3/2011 |

* cited by examiner

DYNAMIC HEARING AID SYSTEM AND A METHOD FOR CONFIGURING THE HEARING AID SYSTEM

FIELD OF THE INVENTION

The present invention relates to a hearing aid system and a method for configuring the hearing aid system.

BACKGROUND OF THE INVENTION

Currently available hearing instruments use digital wireless transmission such as radio frequency (RF) not only for remotely controlling the operating parameters for example, volume of the hearing aids (HA) from a handheld unit but also for streaming audio data from a source such as a television, telephone, etc. to the HA, bypassing the acoustic path of a loudspeaker and a microphone and thus eliminating the influence of environmental noise on the perceived audio quality.

High-end hearing instruments generally involve three kinds of devices, that is right and left hearing aids (HA), an audio streamer (AS) and a remote control (RC), which are connected by wireless links. The audio streamer is connected with a stereo audio source and transmits encoded and typically compressed digital audio data to the hearing aids. The hearing aids have two working modes, that is, non-streaming mode and streaming mode. In the non-streaming mode the hearing aids work in a conventional way which is amplifying the acoustic signals picked up by the built-in microphones, while in the streaming mode the hearing aids receive and play back the audio signals transmitted by the audio streamer. The remote control is used to control the functions of the hearing aids, such as volume adjustment, mode switching and so on.

Audio streaming for hearing aids currently exists in at least two varieties, namely direct streaming from the streaming device to the hearing aids, and indirect streaming, in which the audio is streamed to from the streamer to the remote control first and then forwarded, usually using a different wireless technology, from the remote control to the hearing aids.

The devices (HA left/right, AS, RC) must be organized as a system and synchronize in some way so that they can communicate with each other in a robust, reliable and energy-efficient manner, taking into account also the real-time requirements of the streamed audio data. Therefore a flexible and adaptive self-organized systemization mechanism becomes a critical issue.

Hearing instruments form a master-slave configuration over the wireless network, wherein one of the devices such as the left and right hearing aids, the audio streamer and the remote control acts as a master and the rest of the devices act as slave. In this configuration the timing of the channel access by all the slave devices is dependent on the timing of the master.

Currently, in the master-slave configuration one of the devices is configured as a master beforehand and the rest of the devices as slaves which follow the master's timing.

However, in the above-mentioned configuration several problems may arise when the master device doesn't work properly or when the communication between the master and the slave devices is interrupted.

SUMMARY OF THE INVENTION

It is therefore an object of the present invention to provide a hearing instrument and a mechanism for the hearing instrument which will enable it to work when the master device is not working properly or during interruption of communication between the master device and the slave devices.

The object is achieved by providing a dynamic hearing aid system as claimed and a method for configuring the hearing aid system as claimed.

According to the present invention a dynamic hearing aid system is provided. The dynamic hearing aid system includes a first hearing device and a second hearing device, and a controller adapted to communicate with each other wherein the hearing devices and the controller form a master-slave configuration, wherein one of the hearing devices is the master hearing device in the master-slave configuration and the other hearing device is the slave hearing device. Such an arrangement enables a flexible, robust and self-organized hearing aid system. By having one of the hearing device as the master and the other device as the slave, the hearing device decides its role dependently by finding out whether the master is present. In case the master is not present the hearing device becomes the master making the system dynamic in nature.

In one embodiment, the slave hearing device changes communication with the controller on losing a connection with the master hearing device. This enables the controller to notice an improper working of the hearing aid system.

In another embodiment, the slave hearing device is configured such that on losing a connection with the master hearing device the slave hearing aid suspends its communication with the controller. By suspension of communication with the controller, the slave hearing aid enables the controller to notice the absence of master hearing device.

In another embodiment, the slave hearing device is configured such that on losing a connection with the master hearing device the slave hearing device sends a respective signal to the controller, informing the controller about an absence of the master hearing device. By sending the signal to the controller, the slave hearing device is able to communicate with the controller in less amount of time.

In one embodiment, the controller is configured to check whether the master hearing device is absent. This enables the controller to inform the slave hearing device to act as a master hearing device or to continue the operation as the slave hearing device.

In one embodiment, the controller is configured to transmit data to the slave hearing device at regular intervals of time. By transmitting data to the slave hearing device at regular intervals of time the controller informs the slave hearing device of the existence of master hearing device, furthermore the slave hearing aid will choose the timing of transmission of signals relative to the timing of the transmission of data by the controller. This enables uninterrupted operation of the hearing aid system.

In one embodiment, the slave hearing device and the master hearing device are battery operated. Battery enables the device to be movable and also be worn on body.

In another aspect of the invention, a method for configuring a hearing aid system is provided. The method includes providing a first hearing device, a second hearing device and a controller adapted to communicate with each other, wherein the hearing devices and the controller form a master-slave configuration, and wherein one of the hearing device is a master hearing device and the other hearing device is a slave hearing device, detecting a presence of the master hearing device by the slave hearing device, wherein on an absence of the master hearing device, the slave hearing device is configured to act as the master. Such an arrangement enables continuous working of the hearing aid system even when the master device is not working properly or when the communication between the master and the slave is interrupted.

In one embodiment, the controller relays the data between the master hearing device and the slave hearing device. This enables joint signal processing between the first hearing device and the second hearing device which enables noise cancellation between the first hearing device and the second hearing device.

The above-mentioned and other features of the invention will now be addressed with reference to the accompanying drawings of the present invention. The illustrated embodiments are intended to illustrate, but not limit the invention. The drawings contain the following figures, in which like numbers refer to like parts, throughout the description and drawings.

DETAILED DESCRIPTION OF THE INVENTION

Embodiments of the present invention relate to listening device such as hearing instruments which include hearing aid systems and a method of configuring the hearing aid system.

Figure 1:
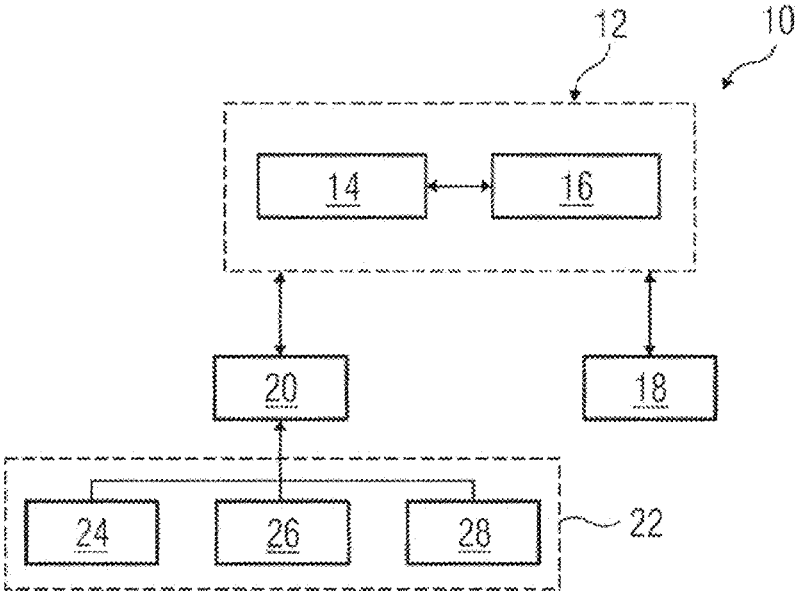
FIG. 1 is a schematic diagram depicting a hearing aid system.

Referring to FIG. 1, a schematic diagram depicting a dynamic hearing aid system 10 is presented. The hearing aid system 10 includes a plurality of hearing aids or hearing devices 12, an audio streamer 20 and a controller 18 in communication with each other through wireless links over a network. The hearing aid system 10 typically includes hearing devices 12, specifically two hearing devices, a first hearing device 14 and a second hearing device 16, at least one of which is adapted to be worn in an ear of a person. In the presently contemplated configuration, the first hearing device 14 and the second hearing device 16 may be worn on the left and right ear of the person respectively. These hearing devices 14, 16 may be in a form of a binaural fitting, a pair of ear plugs or a pair of headphones and so forth. In accordance with aspects of the present technique, the audio streamer 20 is connected with a stereo audio source 22 and is adapted to transmit an encoded and typically compressed digital audio data to the hearing devices 12. The stereo audio source may include a mobile phone 24, a television 26 or a music system 28 for example.

The controller 18 is used for controlling the function of the hearing devices 12, such as but not limited to volume adjustment, mode switching and so forth.

In the exemplary hearing aid system 10, the various devices such as the hearing devices 12, the controller 18 and the audio streamer 20 form a master-slave configuration, wherein one of the devices is a master and the others are slave in the network. Furthermore, in the master-slave configuration one device has a unidirectional control over the other devices in the network. It may further be noted that in the master-slave configuration, the timing of a channel access by all the other devices, which are the slave devices is dependent on the timing of the master.

In accordance with aspects of the present technique, the first hearing device 14 is a master hearing device and the second hearing device 16 is a slave hearing device.

More particularly, according to the aspects of the present technique one of the hearing devices is configured to act as the master in the exemplary hearing aid system.

As previously noted, the currently described hearing aid system 10 is dynamic in nature, wherein at any instant of time one of the hearing device 14, 16 is the master of the network.

Hearing devices, such as the first hearing device 14 and the second hearing device 16, include a radio frequency (RF) chip with a microcontroller and an audio codec chip. As used herein, the microcontroller is a small computer on a single integrated circuit containing a processor core, memory, and programmable input/output peripherals. Additionally, the controller 18, which is typically a remote control, also includes an RF chip with a microcontroller. The controller 18 uses RF transmission to control the operating parameters, such as volume, mode switching and so forth.

In a normal mode of operation, the first hearing device 14 acts as a master hearing device and the rest of the devices such as the second hearing device 16 and the controller 18 act as slaves following the timing of the master.

Figure 2:
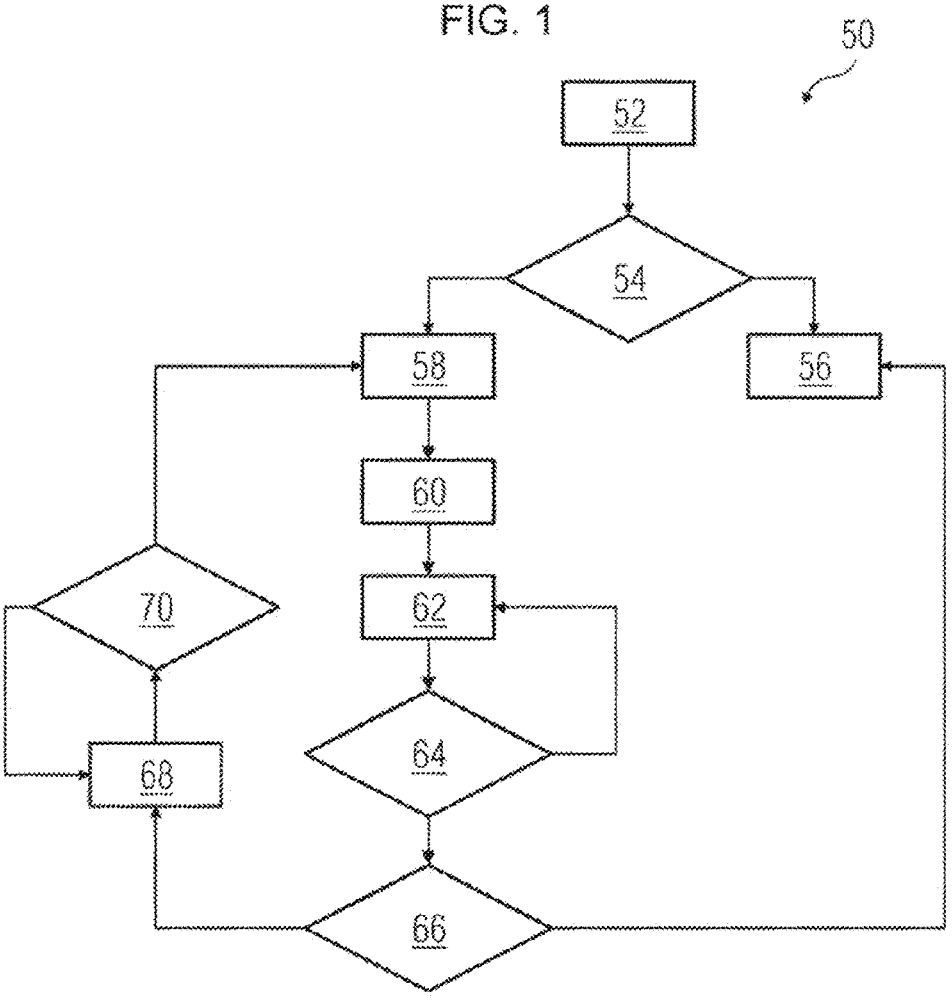
FIG. 2 is a flowchart depicting an exemplary method of configuring the hearing aid system of FIG. 1.

FIG. 2 is a flowchart depicting an exemplary method 50 for configuring the hearing aid system 10. As previously noted, the hearing aid system 10 includes the first hearing device 14 configured to act as the master and the second hearing device 16 and the controller 18 configured to act as slave.

The method 50 starts at step 52, wherein the first hearing device 14 and/or the second hearing device 16 is switched on. The hearing devices 14, 16 are typically battery driven devices, having a switch (not shown) to power the device in an on or an off position.

At step 54, the first hearing device 14 or the second hearing device 16 detects whether a hearing device is already present. As an example, the first hearing device 14 when switched on tries to detect the presence of the second hearing device 16. Alternatively, the second hearing device 16 when switched on will detect the presence of the first hearing device 14.

In a situation where the hearing device is not present, the first hearing device 14 or the second hearing device 16 will work as a master and would dominate the timing for communication with the controller 18, as at step 56.

However, when the hearing device is present, the first hearing device 14 will act as the slave hearing device and follow the timing of the master hearing device which in this case would be the second hearing device 16, as at step 58.

Thereafter, the slave hearing device will synchronize with the timing of the master hearing device and follow the master hearing device's timing, as at step 60.

It may be noted that the hearing aid system 10 in the presently contemplated configuration works in a direct streaming mode wherein audio signals transmitted by the audio streamer 20 are received and played back by the hearing devices 12. In the streaming mode both the master hearing device 14 and the slave hearing device 16 synchronize with the audio streamer 20, while the slave hearing device 16 and the controller 18 maintain their synchronization with the master hearing device 14.

More particularly, the master hearing device 14 regularly transmits or broadcasts "beacon packets". As used herein, "beacon packets" in a wireless network are small packets generally known as "beacons" that are transmitted continuously advertising the presence of the master device. The other devices (slave devices) in the network sense the beacons and attempt to establish the wireless connection. The slave devices find the beacon packets and synchronize with the master hearing device.

At step 62, the normal working mode of operation of the hearing aid system 10 is achieved.

However, in a situation where the slave hearing device 16 disconnects with the master hearing device 14, as at step 64, it is verified whether the master hearing device 14 is absent, as at step 66. The verification regarding the absence of the master hearing device 14 is done from the controller 18.

It may be noted that the abovementioned situation where the slave hearing device 16 is unable to connect with the master hearing device 14 may arise due to a bad wireless link between the hearing devices 14, 16. Typically, hearing aid system 10 works on high frequency bands, such as, but not limited to 2.4 GHz, a human head is an obstacle for the electromagnetic wave with such a high frequency, thereby potentially affecting communication between the hearing devices.

The slave hearing device 16 on losing connection with the master hearing device 14 changes communication with the controller 18. The slave hearing device 16 may suspend the communication with the controller 18, or alternatively, the slave hearing device 16 may send a respective signal to the controller 18, informing the controller 18 about an absence of the master hearing device 14.

The controller 18 checks the presence of the master hearing device 14 since the wireless communication between the controller 18 and the master hearing device 14 is independent of the communication between the slave hearing device 16 and the master hearing device 14. At step 66, if it is verified by the controller 18 that the master hearing device 14 is absent, then the slave hearing device 16 is configured to work as a master as in step 56.

However, if it is verified by the controller 18 that the master hearing device 14 is present at step 66, the hearing aid system 10 is operated in special operating mode as indicated by step 68. The special operating mode will be described in more detail with reference to FIG. 3.

At step 70, it is verified by the hearing aid system 10 if the slave hearing device 16 is able to communicate with the master hearing device 14. On detecting the existence of the master hearing device 14 by the slave hearing device 16 the hearing aid system 10 works in normal operation mode.

Figure 3:
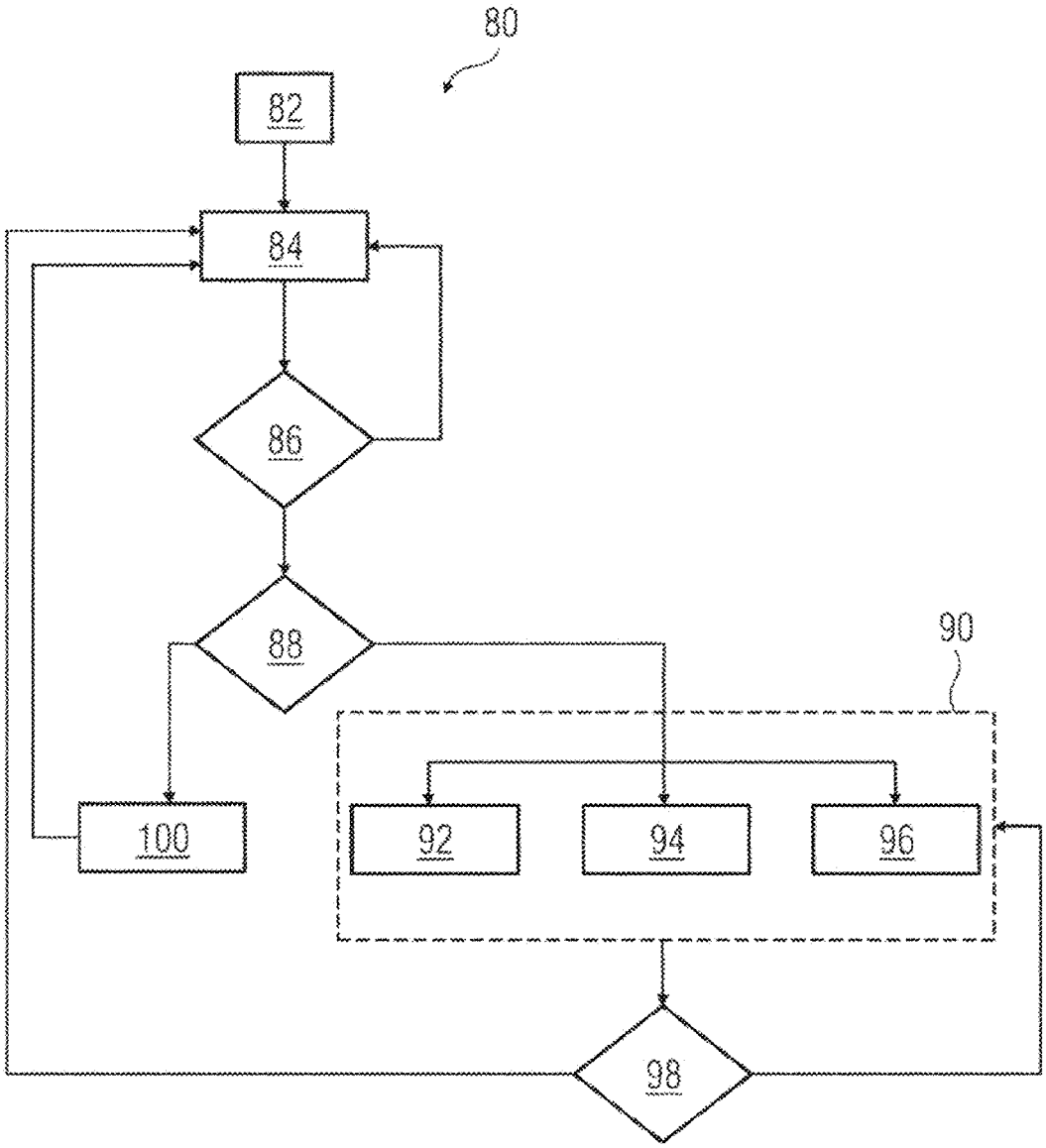
FIG. 3 is a flowchart depicting the actions taken by a controller of the hearing aid system, in accordance with aspects of the present technique.

Referring now to FIG. 3 a flowchart depicting a control scheme 80 of the actions taken by the controller 18 in the method 50 for configuring the hearing aid system 10 is presented. At step 82, the hearing devices 14, 16 are switched on. Thereafter the hearing aid system 10 works in a normal mode, wherein one of the hearing devices 14, 16 is a master hearing device and the other hearing device is a slave hearing device, as at step 84. For the purpose of present description, the first hearing device 14 may be considered as the master hearing device and the second hearing device 16 may be considered as the slave hearing device.

At step 86, it is verified if the slave hearing device 16 has lost connection with the master hearing device 14. In case, the slave hearing device 16 has lost connection with the master hearing device 14 it is detected if the master hearing device 14 is absent, as at step 88.

In a situation where the master hearing device 14 is absent, the controller 18 issues a role-switch command to the slave hearing device 16, wherein the slave hearing device 16 is configured to act as a master, as at step 100.

However, in a situation where the master hearing device 14 is present and the slave hearing device 16 is unable to connect with the master hearing device 14, the controller 18 performs the following actions as at step 90. These actions enable the hearing aid system 10 to work in special operating mode.

Step 90 is representative of the actions that the controller 18 may take in a situation when the slave hearing device 16 is unable to communicate with the master hearing device 14 even though the master hearing device 14 is present.

As depicted, at step 92, the controller 18 will inform the slave hearing device 16 about the existence of the master hearing device 14, enabling the slave hearing device 16 to continue with the normal operation. However, it may be noted that for signal transmission to the controller 18 and/or to the master hearing device 14, the slave hearing device 16 will choose the timing relative to the controller's timing. Particularly, if the controller 18 does not transmit any signal for an extended period of time, the slave hearing device will not initiate any transmission since a "clock drift" may cause collisions with packets from the master hearing device 14 at the controller 18.

It may be noted that in a system typically having a master slave configuration every device has a clock that is used to determine when to send and/or listen for data. These clocks run at different speeds having an inherent level of accuracy which makes them run slower or faster than a nominal frequency. Hence, there will be an increasing difference in the "time" these clocks would display. This is typically known as "clock drift". During a normal operation the master defines the times in which the slave is allowed to transmit by regularly announcing these times. With every announcement, the slave can check and reset its internal clock. By this mechanism it is ensured that at least a maximum difference between the clocks is never exceeded. The maximum difference can also be taken into account when defining the time slots for transmission, such as but not limited to adding some guard interval in which none of the devices should transmit data.

With continuing reference to FIG. 3, as at step 94, the controller 18 may transmit "dummy" packets to the slave hearing device 16 at regular intervals of time, allowing the slave hearing device 16 to initiate transmissions to the controller 18. It may be noted that independent of the content of the dummy packets, the controller 18 relays information about the timing of the master hearing device 14 to the slave hearing device 16 thereby avoiding the problem of clock drift.

Additionally, as at step 96, the controller 18 may relay data between the master hearing device 14 and the slave hearing device 16 to enable the hearing aid system 10 to work normally.

Subsequently, at step 98, it is verified if the slave hearing device 16 is able to communicate with the master hearing device 14. In case the slave hearing device 16 is able to communicate with the master hearing device 14 the hearing aid system 10 resumes the normal operation.

The dynamic hearing aid system as described hereinabove has several advantages such as but not limited to flexibility, robustness and has self organized mechanism for converting the slave hearing device to the master hearing device wherein the hearing devices decide their role dependently. The above mentioned system is dynamic enabling the slave hearing device to assume the role of the master hearing device, in case the master hearing device is absent.

Additionally, the invention reduces power consumption and extends battery life of the hearing devices by ensuring stable system operation even if the connection between the first hearing device and the second hearing device sporadically breaks down. The transmit power of the hearing devices may therefore be chosen without a large "safety margin" that ensures connectivity between the first hearing device and the second hearing device at all times.

Although the invention has been described with reference to specific embodiments, this description is not meant to be construed in a limiting sense. Various modifications of the disclosed embodiments, as well as alternate embodiments of the invention, will become apparent to persons skilled in the art upon reference to the description of the invention. It is therefore contemplated that such modifications can be made without departing from the embodiments of the present invention as defined.

The invention claimed is:

1. A dynamic hearing aid system, comprising:

a first hearing device;

a second hearing device; and a controller;

said first and second hearing devices and said controller being configured to communicate with each other;

said first and second hearing devices and said controller forming a master-slave configuration, wherein one of said first and second hearing devices is a master hearing device in said master-slave configuration and the other one of said first and second hearing devices is a slave hearing device; and said slave hearing device being configured to detect a presence of said master hearing device and, upon determining that said master hearing device is absent, to act as a master.

2. The dynamic hearing aid system according to claim 1, wherein said slave hearing device is configured, upon losing a connection with said master hearing device, to change a communication with said controller.

3. The dynamic hearing aid system according to claim 2, wherein said slave hearing device is configured, upon losing a connection with said master hearing device, to suspend a communication of said slave hearing device with said controller.

4. The dynamic hearing aid system according to claim 2, wherein said slave hearing device is configured, upon losing a connection with said master hearing device, to send a respective signal to said controller, informing said controller about an absence of said master hearing device.

5. The dynamic hearing aid system according to claim 1, wherein said controller is configured to check whether said master hearing device is absent.

6. The dynamic hearing aid system according to claim 1, wherein said controller is configured to transmit data to said slave hearing device at regular time intervals.

7. The dynamic hearing aid system according to claim 1, wherein said slave hearing device and said master hearing device are battery driven devices.

8. A method of configuring a hearing aid system, the method comprising:

providing a first hearing device, a second hearing device, and a controller adapted to communicate with each other, wherein the first and second hearing devices and the controller form a master-slave configuration, with one of the hearing devices being a master hearing device and the other hearing device being a slave hearing device;

detecting a presence of the master hearing device by the slave hearing device; and upon determining that the master hearing device is absent, acting as a master by the slave hearing device.

9. The method according to claim 8, which further comprises changing a communication by the slave hearing device with the controller on losing a connection with the master hearing device.

10. The method according to claim 9, wherein a change in communication by the slave hearing device comprises suspending a communication with the controller.

11. The method according to claim 9, wherein a change in communication by the slave hearing device comprises transmitting a signal to the controller, informing the controller of an absence of the master hearing device.

12. The method according to claim 8, which comprises verifying an absence of the master hearing device by the controller.

13. The method according to claim 8, which comprises transmitting data by the controller to the slave hearing device at regular intervals of time.

14. The method according to claim 8, which further comprises communicating a presence of master hearing device to the slave hearing device by the controller.

15. The method according to claim 8, which comprises relaying data between the master hearing device and the slave hearing device.

* * * * *